US006789892B2

(12) United States Patent
Hetzer et al.

(10) Patent No.: US 6,789,892 B2
(45) Date of Patent: Sep. 14, 2004

(54) CONFIGURATION FOR PROTECTION OF A PRINTING MODULE IN A MAIL PROCESSING APPLIANCE AND MAIL PROCESSING APPLIANCE INCLUDING THE CONFIGURATION

(75) Inventors: Ulrich Hetzer, Berlin (DE); Uwe Hübler, Neuenhagen (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 17 days.

(21) Appl. No.: 10/320,952

(22) Filed: Dec. 16, 2002

(65) Prior Publication Data

US 2003/0112315 A1 Jun. 19, 2003

(30) Foreign Application Priority Data

Dec. 15, 2001 (DE) ..... 101 64 527

(51) Int. Cl.[7] ..... B41J 29/13; B41J 29/02; B41J 29/12; B41J 3/39

(52) U.S. Cl. ..... 347/108; 400/691; 400/693

(58) Field of Search ..... 347/4, 108, 49, 347/50; 400/691, 693

(56) References Cited

U.S. PATENT DOCUMENTS

| | | | |
|---|---|---|---|
| 4,767,228 A | 8/1988 | Harry | |
| 5,901,644 A | 5/1999 | Etheridge et al. | |
| 6,024,429 A | 2/2000 | Coffy et al. | |
| 6,041,704 A | 3/2000 | Pauschinger | |
| 6,102,534 A | 8/2000 | Herbert | |
| 6,456,776 B2 * | 9/2002 | Hetzer | 385/147 |

FOREIGN PATENT DOCUMENTS

| | | |
|---|---|---|
| EP | 0 875 861 A2 | 11/1998 |
| EP | 0 875 865 A2 | 11/1998 |
| EP | 0 881 086 A2 | 12/1998 |
| EP | 0 927 972 B1 | 7/1999 |
| EP | 1 095 780 A1 | 5/2001 |

* cited by examiner

*Primary Examiner*—Stephen D. Meier
*Assistant Examiner*—Alfred Dudding
(74) *Attorney, Agent, or Firm*—Laurence A. Greenberg; Werner H. Stemer; Ralph E. Locher

(57) ABSTRACT

A configuration protects a printing module in a mail processing appliance. The mail processing appliance has a supporting frame for the printing mechanism in a non-secure area and has a transverse movement device for transverse movement of a printing module. The printing module is disposed in the supporting frame such that it can move transversely with respect to a direction of mail item transport and is mechanically protected against unauthorized access. A protection cap is attached to the printing carriage and is constructed to surround an area of the variable position printing module that is to be protected. The movement area of the printing module is bounded by the walls of a box within the supporting frame. Impeding devices are provided to impede the transverse movement of the transverse movement device of the printing module once a cover has been opened or removed. The cover covers an opening in the housing, with the opening being provided for replacement of at least one ink cartridge. A mail processing appliance including the configuration is also included.

17 Claims, 8 Drawing Sheets

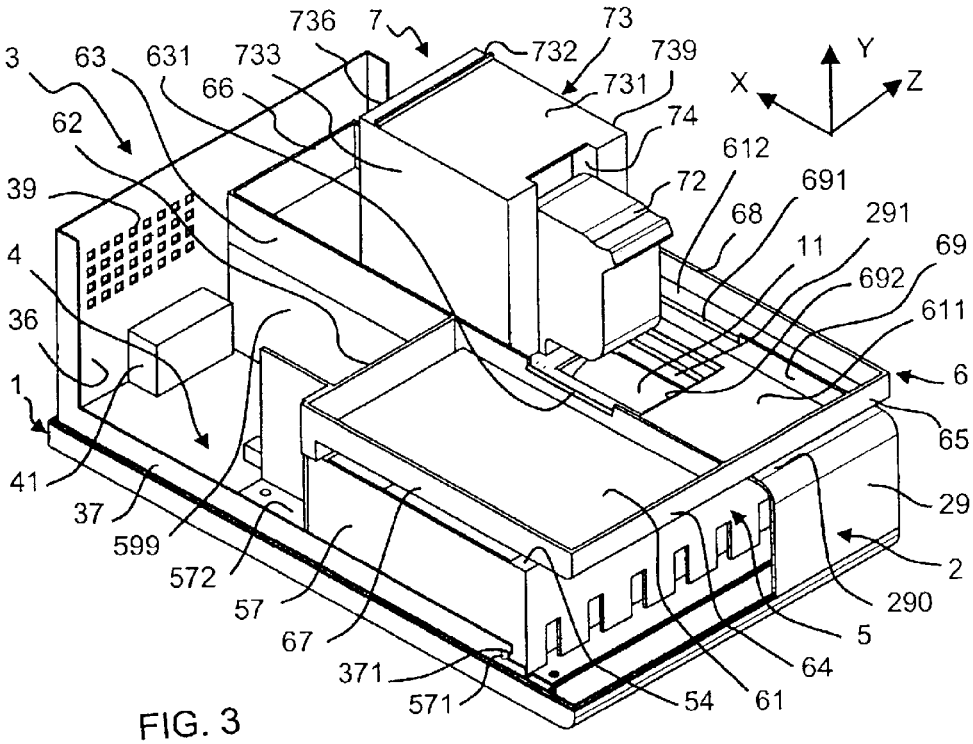
FIG. 3
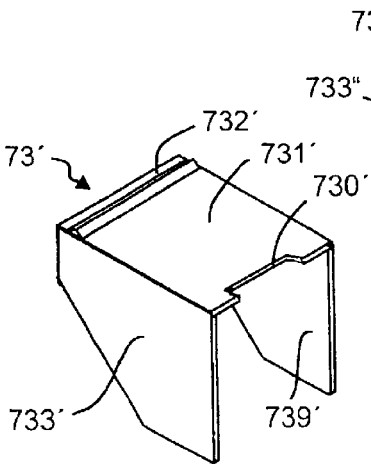
FIG. 7
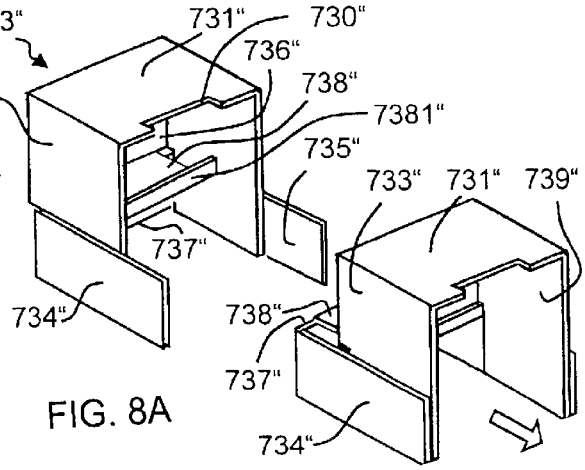
FIG. 8A
FIG. 8B

CONFIGURATION FOR PROTECTION OF A PRINTING MODULE IN A MAIL PROCESSING APPLIANCE AND MAIL PROCESSING APPLIANCE INCLUDING THE CONFIGURATION

BACKGROUND OF THE INVENTION

Field of the Invention

The invention relates to a configuration for protection of a printing module in a mail processing appliance and to mail processing appliances including the configuration. The invention is suitable for appliances having a security housing and that have a secure area and a non-secure area in the interior, with a printing module being disposed in the non-secure area such that it can move, and in which case the printing module must be protected against unauthorized access. The configuration is used in particular in franking machines, addressing machines, and other mail processing appliances having an ink jet printing apparatus.

The T1000 thermal transfer franking machine manufactured by Francotyp-Postalia AG is a thermal transfer printing head that is disposed in a fixed position in the housing, for printing a franking stamp. The franking stamp includes postal information that is entered in advance and is stored, including the postal charge data for carrying the letter, and is produced and printed in the secure area in the interior of the housing. A compartment that is fitted externally on the housing bounds a non-secure area and is used for accommodating a replaceable ink ribbon cassette. While a door that leads to the compartment can be open at any time, access to the secure area of the printing apparatus is prevented by a security housing; see U.S. Pat. No. 4,767,228.

When a franking machine needs to be opened for repair purposes, tear-screws on the security housing must be destroyed. Furthermore, lead seals or plastic parts may be used as further access protection to the microprocessor controller and to the drive lines for the stationary printing head in franking machines and in other mail processing appliances with a security housing. After any repair that involves opening of the security housing, the tear-off screws for the security housing, lead seals, or the plastic parts that are used for access protection must be replaced.

The franking machines such as those sold under the trademark JETMAIL® by Francotyp-Postalia AG are equipped with a base and with a removable meter. Only the latter is protected against misuse by an appropriately constructed housing. In contrast to this, the housing for the base, which contains a postal material transport apparatus and an inkjet printing apparatus need not have any protective function and may be constructed such that it is easy to repair. Because the ink tank is disposed separately from the printing head and can be replaced, there is no need to replace the printing head. Furthermore, no particular security measures may be taken for the printing head or for protection of the drive and data signals if a security stamp with a marking which allows subsequent checking of the genuineness of the security stamp is printed by a special piezo inkjet printing head; see U.S. Pat. No. 6,041,704.

Inkjet printing heads are also already used in the printing module (for example, in those sold by Francotyp-Postalia AG under the trademark MYMAIL®, PERSONAL POST from Pitney Bowes and in the PORTOSTAR from Neopost) in franking machines with a security housing, that is to say without a separate housing for the base and a separable meter. An ink tank and a bubble jet printing head are integrated in a replaceable ink cartridge, as is already known, for example, from the half-inch ink cartridges from the company Hewlett Packard. Because a non-secure area is formed in the interior of the security housing for the printing module, it must be possible for the user to open a hatch in the security housing in order to remove an empty ink cartridge, and to replace it. The access to the printing mechanism that this allows, and possibly to the printer electronics and contact with the ink cartridge may result in new opportunities to produce a security stamp that is not genuine. Some postal authorities place relatively stringent requirements on the licensing of franking machines, which have resulted in their manufacturers equipping such ink cartridges with additional security devices, or adopting suitable protection measures, such that it is impossible to influence the printing process directly or indirectly via manipulated ink cartridges, in order to print franking stamps without having to pay for them.

In addition to the purely electronic solutions, solutions are also already known which mechanically prevent a further printing appliance being driven by the printing data in an unapproved manner during the printing process. According to U.S. Pat. No. 6,102,534 (which corresponds to European Patent Application No. EP 875 861 A2), a franking machine for printing franking stamps can be operated only when a hatch is closed. However, the hatch still needs to be opened in order to remove or to replace an empty ink cartridge. None of the abovementioned solutions allow particular protection for a secure area in the interior of the appliance housing.

However, it should still be possible for the user of a franking machine to remove or to replace an ink cartridge without this providing any opportunity for manipulation through an opening which is required for this purpose, in order to gain access to the internal secure area.

SUMMARY OF THE INVENTION

It is accordingly an object of the invention to provide a configuration for protection of a printing module in a mail processing appliance and a mail processing appliance including the configuration that overcome the hereinaforementioned disadvantages of the heretofore-known devices of this general type and that develop a housing construction with internal chassis parts that cover the inner secure area and protect a printing module. The printing module is disposed in the non-secure area such that it can move, against unauthorized access, while incurring only small production costs in the process. Furthermore, the risk of accidents during authorized access is intended to be avoided.

With the foregoing and other objects in view, there is provided, in accordance with the invention, an interior of the security housing contains at least one secure area and at least one non-secure area. The non-secure are is accessible through an opening in the security housing. The abovementioned opening and the non-secure area are located, for example, in the housing upper part of the security housing and are separated as far as possible from the secure area in the interior of the security housing. The secure area is preferably located at the bottom of the security housing. A printing module is disposed in the supporting frame such that it can move, and is mechanically protected against unauthorized access. This is based on the fundamental idea that all the control and data lines for the printing module are still routed in a flexible ribbon cable, without any special protection sheath. A protection cap that is attached to the printing carriage of the printing module is also moved when the printing carriage is moved by transverse movers transversely with respect to the direction in which the item of mail is transported. The protection cap is constructed to surround an area of the variable position printing module that is to be protected. An appliance construction with internal chassis parts protects the secure area in the interior of the security housing against unauthorized access. At least two chassis shells, which are at a distance from one another, surround the secure area. A supporting frame for the printing mechanism in the non-secure area is supported on at least one functional edge of at least one chassis shell. This construction dissipates the weight and the forces that act as a result of the printing mechanism via the supporting frame to the chassis upper shell, and from there via the chassis lower shell to the housing lower part.

The printing mechanism is advantageously easily accessible for servicing and for replacement of the ink cartridge. After entering an unauthorized signal, the printing carriage is moved with the ink cartridge to a replacement position, from which the ink cartridge can be removed or replaced. A cover, that covers the abovementioned opening, is provided for the user. The cover is not a component of the security housing and can be opened and removed at any time. When the cover has been opened or removed, the transverse mover impedes transverse movement of the printing module. The flexible ribbon cable is admittedly located under the opening when the printing carriage is moved to the printing position for printing, but the protection cap prevents access to the data and control lines in the ribbon cable. The printing carriage is not moved during the printing process. In any other position to which the printing carriage can be moved when the cover is closed, the abovementioned opening is not closed, or is not closed completely, by the protection cap. The protection cap is constructed to surround an area of the variable position printing module that is to be protected. The protection cap is attached to the printing carriage and closes the abovementioned opening in the housing only partially, corresponding to the movement of the printing carriage in or away from the direction of the printing position.

With the objects of the invention in view, there is also provided a mail processing appliance including a non-secure area, a supporting frame, a printing module, a transverse movement device, a housing upper part, a cover, a print carriage, a protection cap, a box, and an impeding device.

The supporting frame for a printing mechanism is in the non-secure area. The printing module is disposed in the supporting frame, moves transversely with respect to a transport direction (Z) of an item of mail over a movement area, and mechanically protects against unauthorized access. The transverse movement device provides transverse movement of the printing module. The housing upper part has an opening formed therein for replacing an ink cartridge. The cover covers the opening of the housing upper part. The protection cap is attached to the printing carriage and surrounds an area of the variable position printing module. The box within the supporting frame has walls bounding the movement area of the printing module. The impeding device impedes the transverse movement device from transversely moving on the printing module once the cover has been opened or removed. A mail processing appliance including the configuration is also included.

Other features that are considered as characteristic for the invention are set forth in the appended claims.

Although the invention is illustrated and described herein as embodied in a configuration for protection of a printing module in a mail processing appliance and a mail processing appliance including the configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is an exploded perspective view of installed chassis parts of the chassis configuration shown in FIG. 2;

FIG. 7 is a perspective view of a second embodiment of a protection cap;

FIGS. 8A and B are perspective views showing a third variant of a protection cap;

DESCRIPTION OF THE PREFERRED EMBODIMENTS

Figure 1:
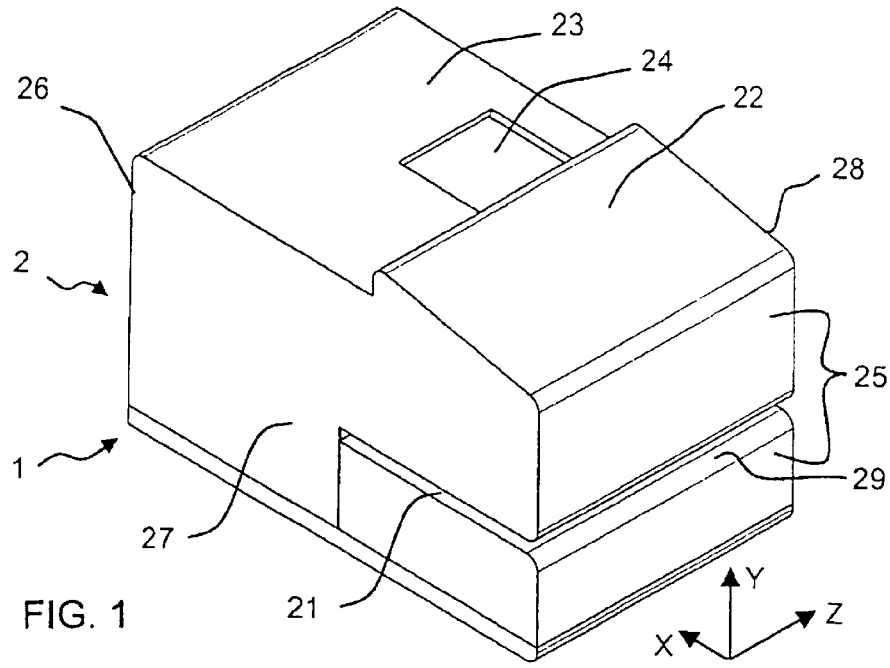
FIG. 1 is a diagrammatic perspective view showing a franking machine according to the invention.

Referring now to the figures of the drawings in detail and first, particularly to FIG. 1 thereof, there is shown a perspective view of a franking machine from the front top left. The plan view in the X direction of the YZ plane in the Cartesian coordinate system corresponds to a view of the franking machine from the front. The plan view in the opposite direction of the Y direction of the XZ plane in the Cartesian coordinate system corresponds to a view of the franking machine from above. The plan view in the Z direction of the XY plane in the Cartesian coordinate system corresponds to a view of the franking machine from the left, on its mail input side 27. A housing lower part 1 is positioned with its lower face, which is not shown, on the XZ plane, or on a plane parallel to the XZ plane.

A removable housing upper part 2 is disposed above the housing lower part 1 in the Y direction. The franking machine has a split front face. The front face 25, the mail input side 27, and the mail output side 28 (which cannot be seen) of the housing upper part 2 have a slotted opening 21 for an item of mail to be franked, which can be supplied in the Z direction. A separately removable housing part 29 with a letter running surface is located underneath the opening 21. The housing upper face has a surface 22 that is inclined toward the front face 25 and that is suitable for accommodating a user interface—not shown. An opening 24 is disposed on the housing upper face 23, which is adjacent to the inclined housing surface 22 in the X direction and is bounded by a housing rear face 26. A flap that is not shown in FIG. 1 is provided for the user as a cover, which covers the abovementioned opening 24 and can be opened or removed at any time. After an unauthorized signal has been entered, a printing module is moved to a position adjacent to the printing position, from which position an ink cartridge can be removed or replaced. Only someone who is authorized to do so, for example a servicing technician, may remove further housing parts. Once the housing lower part 1 and upper part 2 have been removed, a chassis configuration remains. The chassis configuration has a number of chassis parts disposed above the housing lower part 1 in the Y direction.

Figure 2:
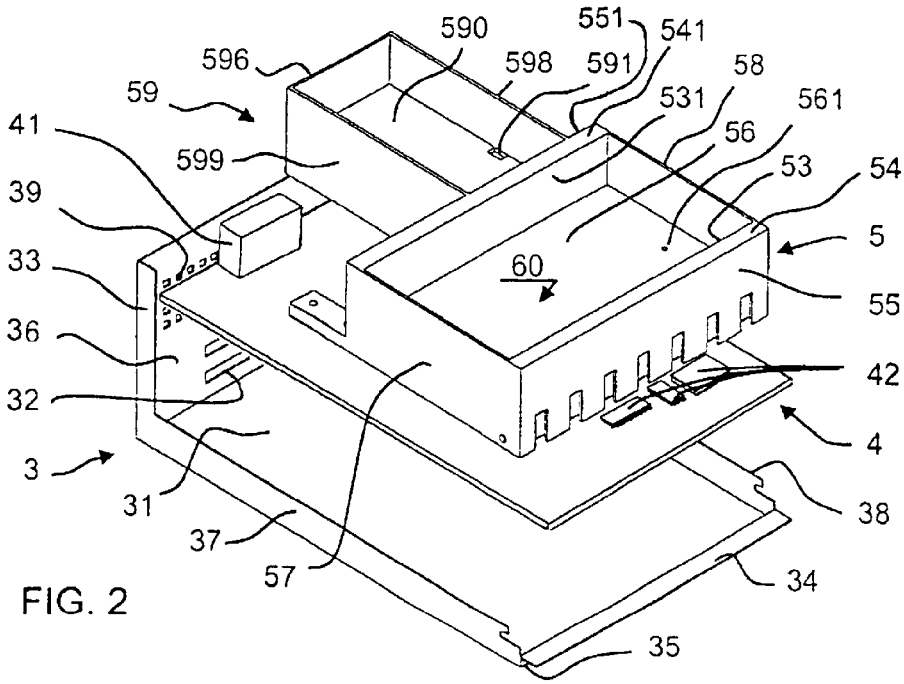
FIG. 2 is an exploded perspective view showing a chassis configuration.

FIG. 2 shows a perspective exploded view of the chassis configuration, which provides mechanical protection for components 42, which are connected to one another on a printed circuit board 4, in an inner secure area. These components 42 belong to the control unit for the franking machine and allow heat dissipation to the exterior by forced convection of an airflow. An upper shell 5, which is shaped appropriately for protection and supporting purposes, is disposed above a lower shell 3, which is shaped for protection and supporting purposes, and the printed circuit board 4. The upper shell 5 may have a group of external ventilation openings, which are disposed in a row and are preferably incorporated in the form of slots on the outer edge. The lower shell 3 includes a shielding and supporting plate 31, which is parallel to the housing lower part 1, and a rearward shielding and supporting sheet-metal part 36, which is angled parallel to the housing rear face 26 and has at least one opening 39 for dissipating a heated air flow to the exterior. At least one component 41 is disposed above the printed circuit board 4 in the Y direction, and is accessible through an opening 32 in the angled rearward shielding and supporting sheet-metal part 36. The abovementioned component 41, which is accessible from the outside, is, by way of example, a plug/socket for a mains connector cable. At least one group 42 of components (which can be seen only partially) is disposed above the printed circuit board 4 in the Y direction and can be covered by the upper shell 5, which is fitted above it, to provide protection against manipulation. A further group of components (which cannot be seen) on the lower face of the printed circuit board 4 are covered by the lower shell 3 in the form of a box in the assembled state. The abovementioned group 42 of components and the further group of components (which cannot be seen) on the printed circuit board lower face are thus disposed such that they are completely inaccessible from the outside, and belong to the inner secure area. The shielding and supporting metal sheet 31 lies parallel to the XZ plane and, for this purpose, has on its side edges, side edge surfaces 37 and 38, respectively, which are angled with respect to the mail input side 27 and with respect to the mail output side 28 and at the same time run parallel to the KY plane. The rearward shielding and supporting sheet-metal part 36 lies parallel to the YZ plane and has, on the side edges, side edge surfaces 33 and 34 (which cannot be seen), respectively, which are angled with respect to the mail input side 27 and with respect to the mail output side 28 and run parallel to the KY plane. The lower shell 3 has a front face sheet-metal part 35, which is angled parallel to the shielding and supporting metal sheet 31 and the housing front face 25 and, in this case, a front-face sheet-metal part 35 which runs parallel to the YZ plane as far as the functional edge and has a skirt 34 which runs parallel to the XZ plane. The transition to the abovementioned skirt 34 of the lower shell 3 is in this case one functional edge of the lower shell 3 which, in the assembled state, is at a distance from the other functional edge 54 of the upper shell 5. The lower shell 3 is used on the one hand for transmitting force to the security housing lower part 1, and on the other hand for dissipating power losses and for compliance with the EMC standard. The chassis upper shell 5 is bounded on the front face in the Y direction by the functional edge 54 and parallel to the front face, or by a functional edge 541, parallel to the rear face, in the Y direction. The functional edge 54 of the chassis upper shell 5 is constructed in the form of an inverted U-shape, that is to say a ∩-shape, and has an inner side wall 53, which is disposed close to the front face, and an outer front side wall 55. The further ∩-shaped functional edge 541 has an inner side wall 531 and an outer rear side wall 551 at a distance from the functional edge 54 of the chassis upper shell 5 in the X direction. One side wall 57 or 58 respectively bounds the chassis upper shell 5 on the mail flow input side and on the mail flow output side. A plate 56, which lies parallel to the shielding and supporting metal sheet 31, splits the internal cavity into a lower cavity and an upper cavity 60. The lower cavity (which cannot be seen) is intended for accommodation of billing and control electronics for the printing, and belongs to the inner secure area. The upper cavity 60 is intended for accommodating a printing mechanism. An opening 561 for cables to pass through is disposed in the plate 56.

In addition, a box 59 can be disposed on the chassis upper shell 5, which extends, by way of example, in the X direction as far as the box rear wall 596 and is bounded in the Z direction, that is to say downstream from the mail flow, by a box side wall 598 and, in the opposite direction to this, that is to say in the upstream mail direction, by a box side wall 599. If the box 59, as is shown, has a box base 590, then at least one opening 591 for electrical cables is provided in the box base 590. By way of example, the box 59 has a greater length in the X direction to the box rear wall 596 than in the Z direction. The box side wall 599 is disposed in the center of the length in the Z direction on the outer side wall 551, with all the walls preferably having the same height in the Y direction.

FIG. 3 shows a perspective view of the installed chassis parts 3, 4, 5 and 6. In the assembled state, the printed circuit board 4, which is fitted with the components of the groups 42 and 45, rests at the front on the skirt 34 of the lower shell 3. The chassis upper shell 5 is supported by its side walls on the printed circuit board 4. Each of the side walls 57 and 58 is equipped with respective attachment devices 571 and 572 and attachment devices 581 and 582 (attachment devices 581 and 582 are similar to attachment devices 571 and 572 but their view is obstructed in FIG. 3) in order to attach the chassis upper shell 5 to the chassis lower shell 3 on the mail flow output side. A supporting frame 6 is disposed above the functional edges 54, 541 of the chassis upper shell 3 as a further chassis part, in order to support the printing mechanism. The supporting frame 6 is bounded by side walls 67 and 68, respectively, on the mail flow input side and mail flow output side. The supporting frame 6 has a length in the Z direction from one side wall 67 to the other 68, which is split centrally by a partition wall 63 into two rectangular boxes, that is to say into a box which is placed on the mail flow input side and has a first base surface, and into a box which is placed on the mail flow output side and has a second base surface, with the box which is placed on the mail flow input side having a smaller base surface area than the box which is placed on the mail flow output side. The box that is placed on the mail flow input side is bounded by a rear side wall 62, which lies in the X direction, by the partition wall 63, by a front side wall 64, and by the side wall 67, and has a base plate 61 with the first base surface area. The partition wall 63 merges in the X direction into a side wall of the box which is placed on the mail flow output side, with the side wall being aligned with the side wall 599 of the box that is disposed underneath it. The box that is disposed above it furthermore has a front side wall 65 and a rear side wall 66 lying in the X direction. All the abovementioned walls 62, 63, 64, 65, 66, 67 and 68 are shown sectioned in height, in order to make it possible to see parts of the printing mechanism. An item of mail (not shown) is transported in the transport direction z with a driven transport drum (shown in FIGS. 4, 5 and 6), which is disposed opposite at least one sprung Opposing printing roller 11 (shown in FIGS. 3 and 6). The opposing printing roller 11, which can be seen in a window-like opening 291 in a letter running surface 290 on the separately removable housing part 29, is not driven. A plate, which has the letter running surface 290, of the housing part 29 is supported on the first functional edge 54 of the chassis upper shell 5.

A printing module 7 has a protection cap 73 and is fitted with at least one replaceable ink cartridge 72, which can be mounted on a printing carriage 74. The protection cap 73 has two side walls 733, 739 and a rear side wall 736, as well as a cover plate 731. The latter has a sealing and guide strip 732.

A filled envelope is moved by a transport drum, which projects through an opening 692 in a base plate 611 of the supporting frame 6, at a predetermined speed in the transport direction Z during the printing process. The box which is placed on the mail flow output side has a further partition wall 69, which extends in the X direction, parallel to the partition wall 63, in order to bind the base plate 611 in the Z direction. Both partition walls 63, 69 have opposite openings 631, 691, which are separated in the Z direction, for the transport drum, in the vicinity of the printing position. A further base plate 612 may be disposed at the same level as the base plate 61 between the partition wall 69 and the side wall 68 on the mail flow output side. The further base plate places an item of mail that is to be franked (see FIG. 1) into a slotted opening 21 in the housing upper part 2. That is, the item of mail is fed in the Z direction and is bound in its thickness from the letter running surface 290 in the Y direction.

The side wall 57 or the side wall 58, which is not illustrated, are respectively equipped with bolts 571 and 581 (which cannot be seen) as attachment devices. The bolt is mounted such that it can rotate in a respective bearing opening 371 or 381 (which cannot be seen) in the respective side edge surfaces 37 and 38 (which cannot be seen), about which the chassis upper shell 5 can rotate when the other attachment devices 572 and 582 (which cannot be seen) are released. Normal attachment devices are breakaway screws or lead-sealed screws.

The secure area protected in this way may also have a high security area internally. Additional mechanical protection is offered by using a further housing to encapsulate the high security area. A security module that is equipped with a billing unit, with a cryptographic unit for protection of the mail charge data to be printed and with its own security housing has been developed for such a high security area for franking machines.

The chassis lower shell 3 has ventilation openings 39 in the rearward shielding and supporting sheet-metal part 36 and, possibly, ventilation openings, which are not shown, in the printed circuit board 4 close to the component 41.

Figure 4:
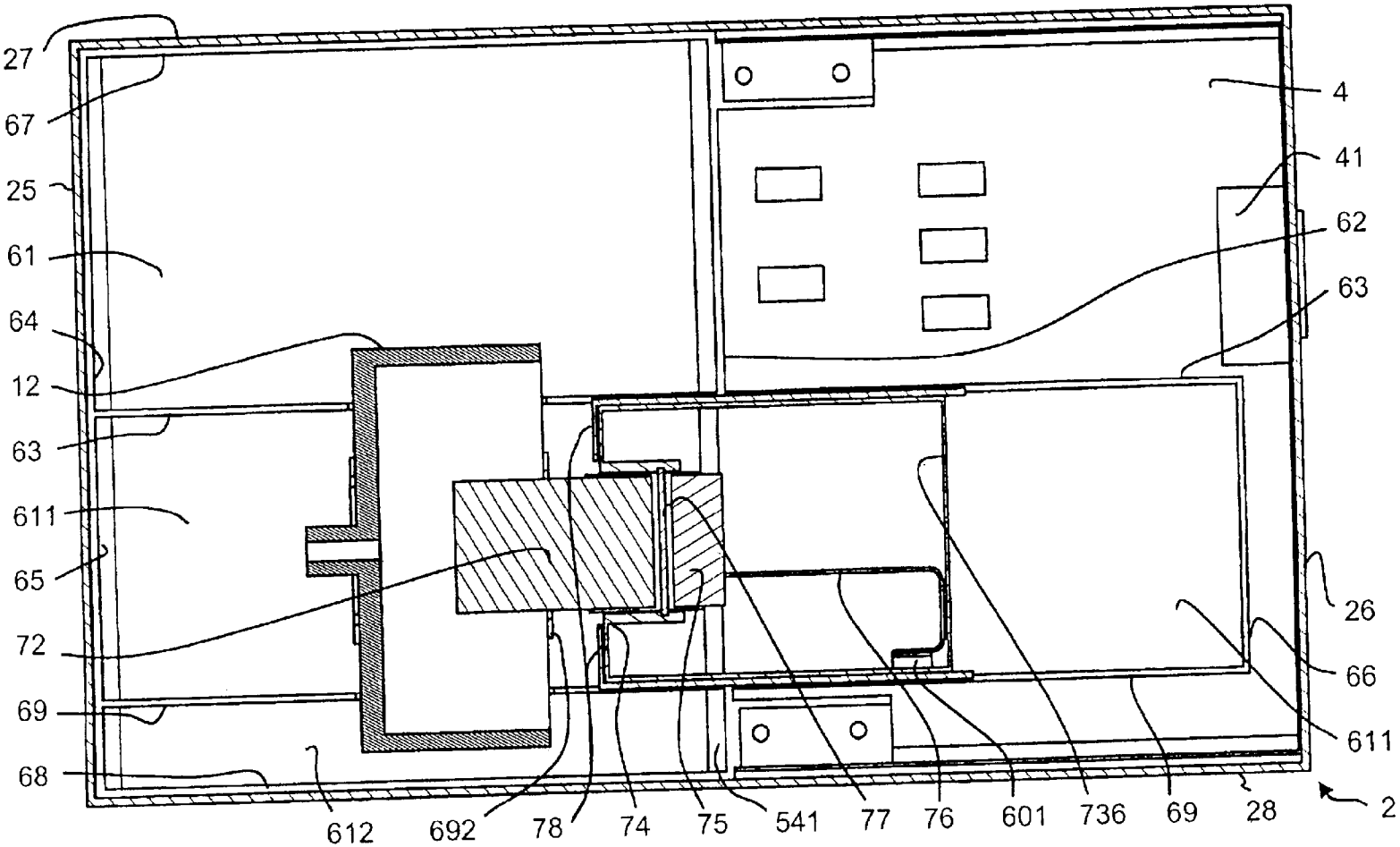
FIG. 4 is a plan view of the franking machine in an XZ plane with a printing module in the printing position.

The position of the printing module in the printing position is shown in a plan view, which is illustrated in FIG. 4, of a franking machine which is sectioned in a XZ plane. The latter is located in the central box of the supporting frame, above the area between the two abovementioned functional edges 54, 541 of the chassis upper shell. The housing rear face 26 is constructed in a suitable manner to allow an airflow, which has been heated by the power losses that are to be dissipated from the components, to escape and is provided with suitable plug connector sockets in order to hold plug-in mains connecting cables as well as telephone and interface cables, etc. A corresponding component 41 is disposed on the printed circuit board 4 on the housing rear face 26 of the housing upper part 2, with the chassis lower shell 3 and the chassis upper shell 5 bounding a secure area on the printed circuit board 4. The rear side wall 66 of that box 63, 65, 66, 69 of the supporting frame which is intended to accommodate the printing module and the transport drum 12 lies parallel to the housing rear face 26. The transport drum is disposed in the vicinity of the front face 25, and is illustrated sectioned through its rotation axis. The running surfaces on the external diameter of the [lacuna] project partially in the boxes 62, 63, 64 and 67 with the bottom surface 61, and in the boxes with the side walls 68, 69 and with the bottom surface 612, which are disposed in the vicinity of the mail input side 27 and mail input side 28, respectively. The rotation axis of the transport drum 12 lies parallel to the X axis. On the side facing the rear face 26, the transport drum 12 has an opening, with the cartridge 72 being shown partially inserted into this opening. An opening 692 is provided in the base plate 611 in the region of the transport drum 12, through which a force is exerted on the item of mail by the transport drum 12, in order to transport the item of mail in the Z direction. An opening that is intended for the franking printing cannot be seen owing to the cartridge position, but may be located sufficiently closely to the opening 692 that the two openings are adjacent to one another. The box 63, 65, 66, 69 of the supporting frame which is provided for accommodating the printing module has a cable bushing opening 601 in the base plate 611, which is at a distance in the X direction from the opening which is intended for the franking printing. This opening 601 is located within the area that is covered by the protection cap 73. The protection cap 73 is mounted on a printing carriage 74, which has an interface 77 for at least one replaceable ink cartridge 72. The protection cap 73 has two side walls 733, 739 and a rear side wall 736, as well as a cover plate 731 (which cannot be seen in FIG. 4). A flexible ribbon cable 76 connects the controller, which is disposed in the secure area, to the printing head drive electronics 75 on the printing carriage 74. If the printing carriage 74 is now moved as far as a stop metal sheet 78 and thus reaches the printing position, then the path for the flexible ribbon cable 76 is extended from the cable bushing opening 601 to the connection on the printing head electronics 75.

Figure 5:
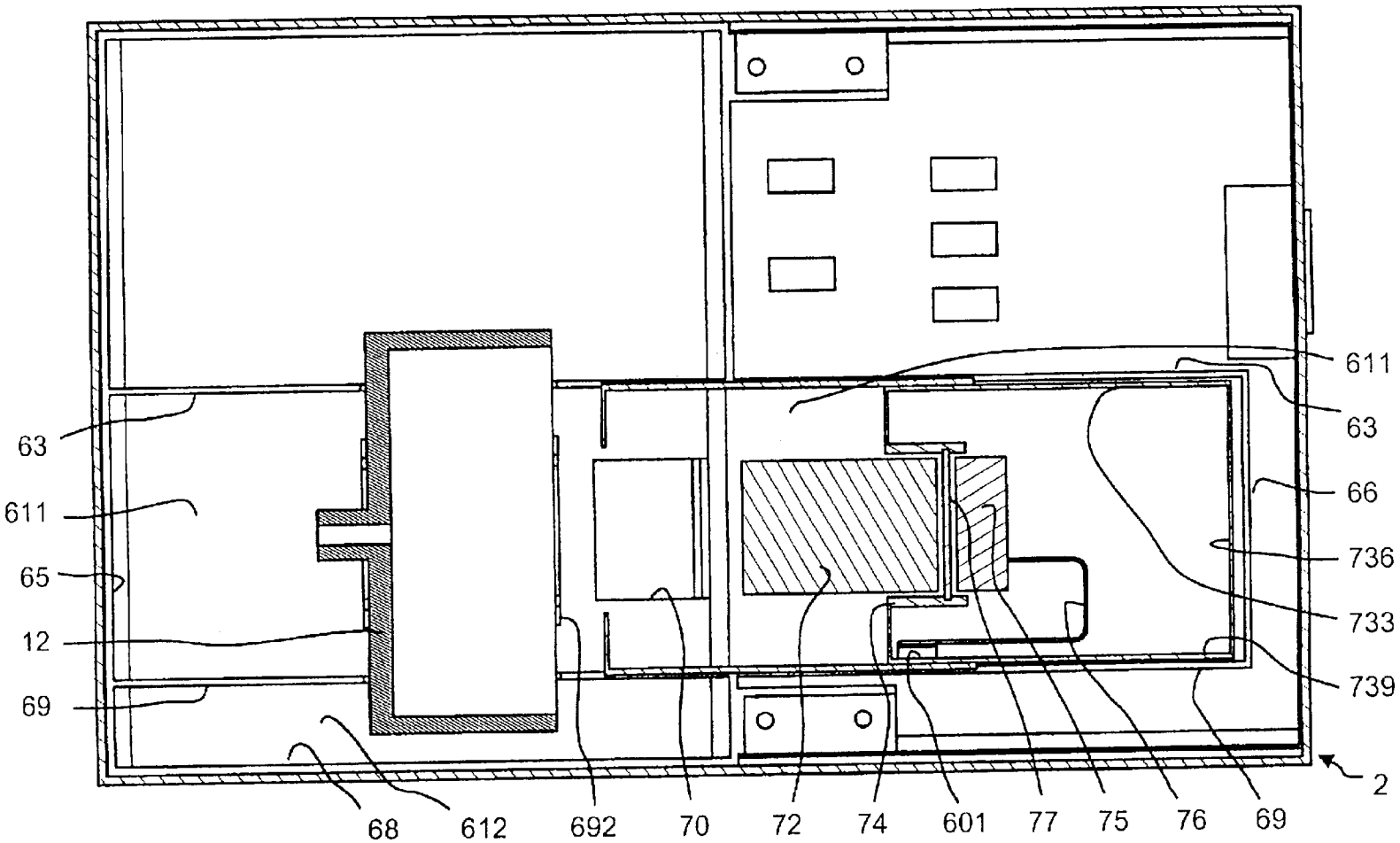
FIG. 5 is a plan view of the franking machine in the XZ plane with the printing module in a cartridge replacement position.

FIG. 5 shows the position of the printing module in the cartridge replacement position of a franking machine that is sectioned in an XZ plane. The latter is located in the central box 63, 65, 66, and 69 of the supporting frame above the area between the abovementioned functional edge 541 of the chassis upper shell and the box rear wall 66, which lies in the direction of the housing rear face 26. The protection cap 73 with side walls 733, 739 and with the rear side wall 736 is moved with the printing carriage 74 away from the stop metal sheet 78 in the X direction, with the rear side wall 736 being moved to a position close to the box rear wall 66, in order to reach the cartridge replacement position. In this case, the route for the flexible ribbon cable 76 from the cable bushing opening 601 to the connection to the printing head drive electronics 75 is compressed. The cartridge 72 is now removed from the opening 70 in the base plate 611 of the central box of the supporting frame to such an extent that it is located precisely under the opening in the housing upper part. The protection cap 73 is constructed to surround the variable area to be protected and, in the process, not to interfere with replacement of the cartridge 72.

Figure 6:
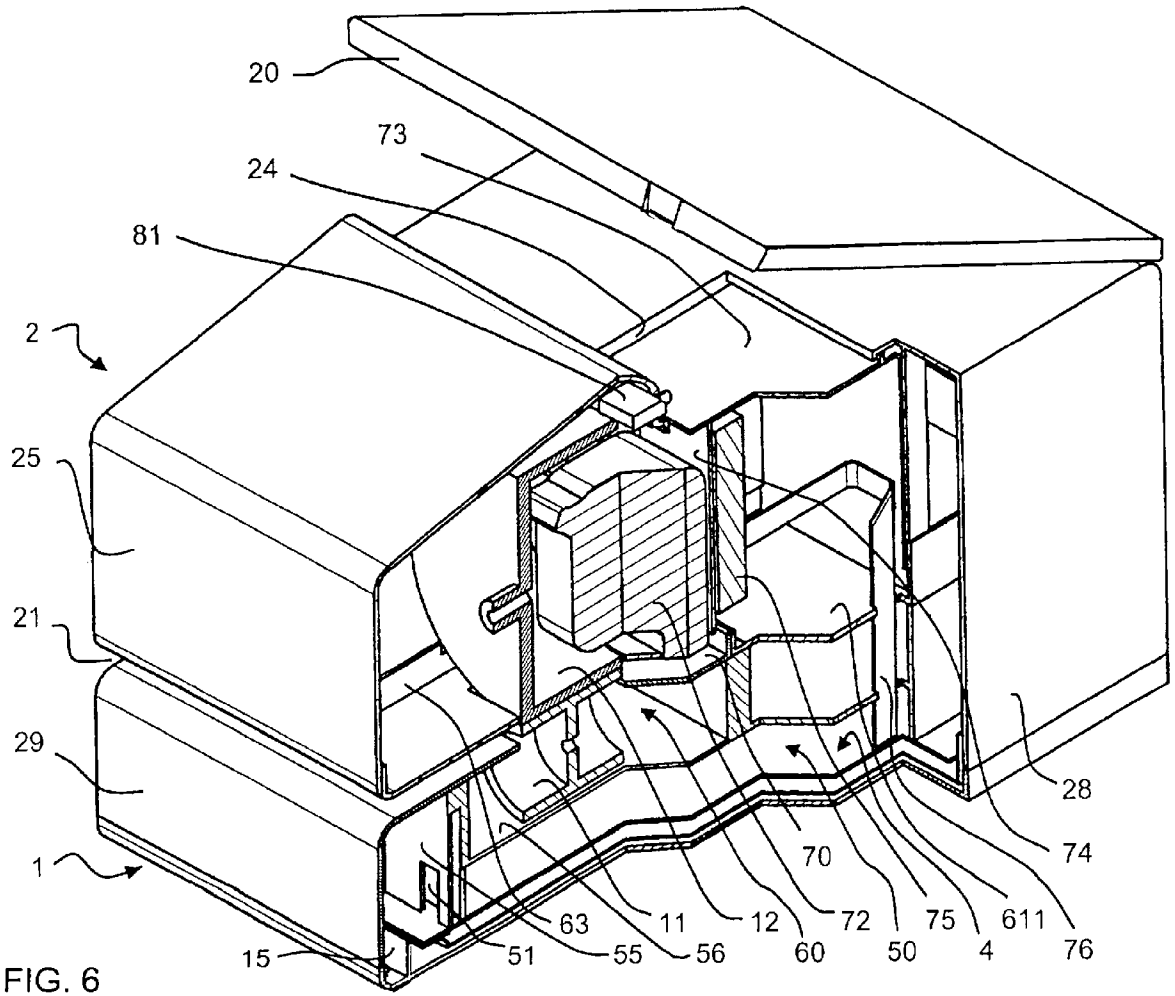
FIG. 6 is a front top right perspective cutaway view of the franking machine.

FIG. 6 shows a perspective view from the right of a sectioned franking machine, with the housing upper part 2 with the slot 21 for feeding in mail on the side wall on the mail input side—which cannot be seen—and with the side wall 28 on the mail output side, with the housing part 29 on the front face 25 of the housing upper part 2, with the partition wall 15 on the housing lower part 1, with the group 51 of openings in the front side wall 55 of the chassis upper shell 5, with the partition wall 63, with the at least one replaceable ink cartridge 72, with the transport drum 12 and with the at least one opposing printing roller 11 shown in their configuration with respect to one another, with the latter being disposed in the space 60 in the chassis upper shell 5, which is separated by the base plate 56 from the space 50 for the components which are disposed on the printed circuit board 4 in the secure area. The printing module, which is disposed such that it can move transversely with respect to the transport direction Z, has a corresponding printing carriage 74 in addition to the at least one replaceable ink cartridge 72, which projects partially into the transport drum 73 in the printing position. Further details relating to this can be found in German patent application 100 32 855.5, which was not published prior to this and is entitled: Apparatus for printing a printing medium.

The ribbon cable 76 is passed from the printed circuit board 4 through the base plate 611 to the connection to the printer drive electronics 75. The protection cap 73 prevents access to the data and drive lines in the ribbon cable 76 and in the printer drive electronics 75 not only during the printing process, that is to say when the printing carriage 74 is moved, for printing with the at least one replaceable ink cartridge 72, into the printing position for printing through an opening 70 in the base plate 611. The protection cap 73 is attached to the printing carriage 74 and closes the abovementioned opening 24 in the housing appropriately to a greater or lesser extent during the movement of the printing carriage in the direction to or away from the printing position. In any other position to which the printing carriage can be moved, the abovementioned opening 24 is not closed or at least not completely closed by the protection cap 73, so that there is a risk of accident if the printing carriage 74 is actually moved when a hand has been inserted into the abovementioned opening 24. A cover 20 is therefore required, for example a flap, but which can be opened at any time. A microswitch 81 then switches off the transverse movement device (not shown) and prevents transverse movement of the printing carriage 74. Alternatively, a sensor 82 may be used, which determines that the flap is in the "open" position before the switching-off process is initiated.

FIG. 7 shows a perspective view of a second embodiment of the protection cap 73'. The protection cap 73' has two side walls 733', 739', and a cover plate 731'. The latter has a sealing and guide strip 732'. The two side walls 733', 739' are constructed to have a reduced area in the X direction, that is to say toward the rear face 66 of the central box of the supporting frame. An opening 730' for replacement of at least one ink cartridge 72 is optionally provided in the protection cap 73', which is constructed to surround an area of the variable position printing module which is to be protected.

FIGS. 8A and B show further perspective views of a third variant of the protection cap 73". The cover plate 731" has a reduced length in the X direction and there is no sealing and guide strip. In order to compensate for this, the third variant of the protection cap 73" also has a rear side wall 736" in addition to the two side walls 733", 739" and as well as a cover plate 731". An opening 730" for replacement of at least one ink cartridge 72 can likewise be provided in the latter. The rear side wall 736" is, however, constructed such that it is halved in the XZ plane, in comparison to the first variant shown in FIG. 3. The missing second half as far as the base plate on the rear face of the protection cap 73" is supplemented or covered by a center plate 737" of a protection cap lower part which forms an edged horizontal U-profile, with two angled side walls 734", 735" in plan view. A cover surface 738" is angled from the center plate 737" so that the side edges of the cover surface 738" lie parallel to the side edges of the side walls 734", 735". The length of the side walls 734", 735" which are angled away from the center plate 737" is approximately twice as great in the X direction as the length of the side walls 733", 739" in the X direction. This allows the protection cap lower part and the protection cap upper part to be moved relative to one another. The cover surface 738" of the protection cap lower part has an angled stop 7381", which limits the relative movement of the protection cap lower part and the protection cap upper part with respect to one another. In FIG. 8*a*, the cover plate 731" is shown moved in the X direction with respect to the abovementioned edged lower U profile.

FIG. 8B shows a perspective view of the protection cap 73", which can be moved telescopically and is moved in the opposite direction, that is to say into the printing position. This third variant with telescopic movement is particularly suitable for mail processing appliances with a small physical depth.

Figure 9A:
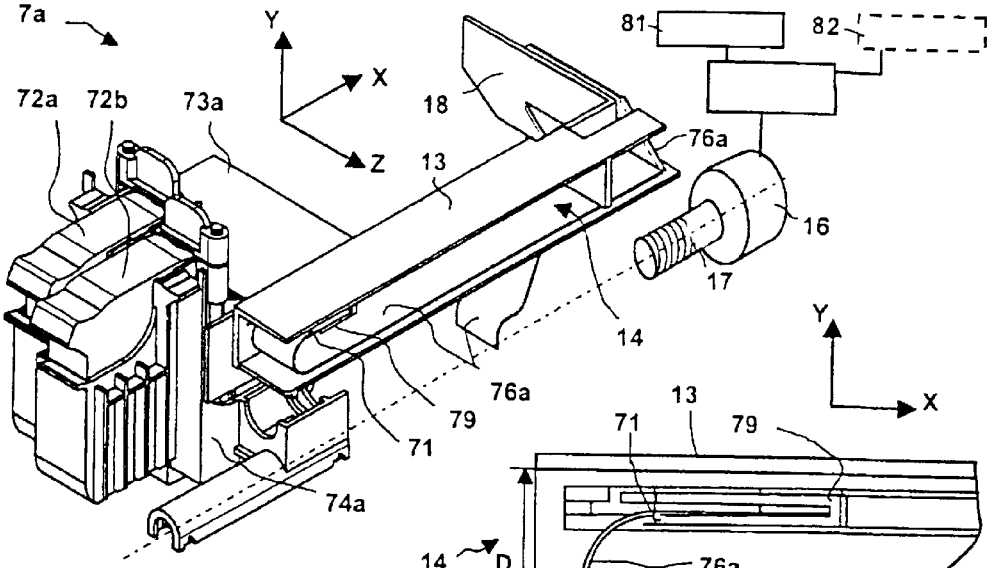
FIG. 9A is a front top right perspective view of a fourth embodiment of the printing module in the printing position.

FIG. 9A shows a perspective view from the front top right of a fourth variant of the printing module. The printing module 7*a* has a protection cap 73*a* which is attached to the printing carriage 74*a*, and has two ink cartridges 72*a* and 72*b*, which are fitted to the printing carriage 74*a*. The latter can be moved from the illustrated printing position to an ink cartridge replacement position by the drive for the transverse movement device 17. A sliding carriage 79 is attached to the printing carriage 74*a* at the side, with a connection 71 for the ribbon cable 76*a*. The sliding carriage 79 is fitted to the printing carriage 74*a* in the Z direction. However, this is not intended to preclude, as an alternative, the possibility of a sliding carriage also being fitted to the printing carriage 74 on the side lying opposite the Z direction. A guide channel 14 extends at the side of the printing module 7*a* in the X direction and is used for guidance and for protection of the ribbon cable 76*a* against unauthorized access to its electrical conductors. The guide channel 14 is bounded by a protection wall 13 in the Y direction, that is to say at the top. An angled piece 18 is formed at the end in the X direction. The guide channel 14 is attached with the protection wall 13 and the angled piece 18 to the supporting frame 6 (not shown). The ribbon cable 76*a* is routed in the Y direction from the secure area to the non-secure area and, after a fold, runs parallel to the Z direction. In this case, the ribbon cable 76*a* lies folded on the angled piece 18 such that its flat face is disposed parallel to the YZ plane. After a further fold, the ribbon cable 76*a* runs parallel to the X direction in the guide channel 14. The ribbon cable 76*a* contains electrical conductors, which are configured in a row at the connection 71 in a line parallel to the Z direction, and its flat face is disposed parallel to the XZ plane.

Figure 9B:
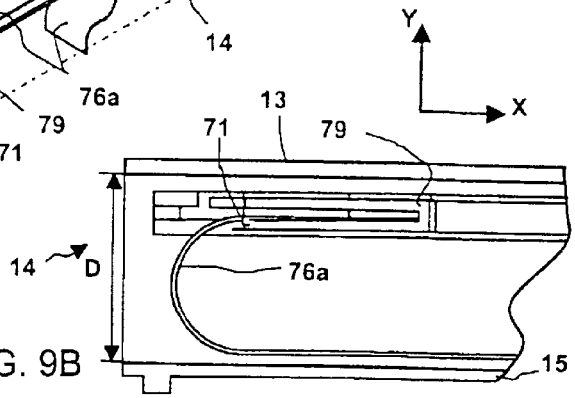
FIG. 9B is a right side view of a guide channel of the fourth embodiment of the printing module.

The side view from the right of the guide channel in the fourth variant of the printing module 7*a* as shown in FIG. 9*b* illustrates an enlarged detail of the guide channel 14 with the sliding carriage 79 and the connection 71 for the ribbon cable 76*a*. The ribbon cable 76*a* is flexible and is bent in a U-shape in the XY plane. During movement of the printing carriage, the ribbon cable 76*a* is guided within the guide channel 14, with the U-shaped curve being moved in the X direction or in the opposite direction to this. There is a parallel channel wall 15 at a distance from the protection wall 13, with the distance D being greater than the minimum permissible bending radius of the ribbon cable 76*a*.

Figure 9C:
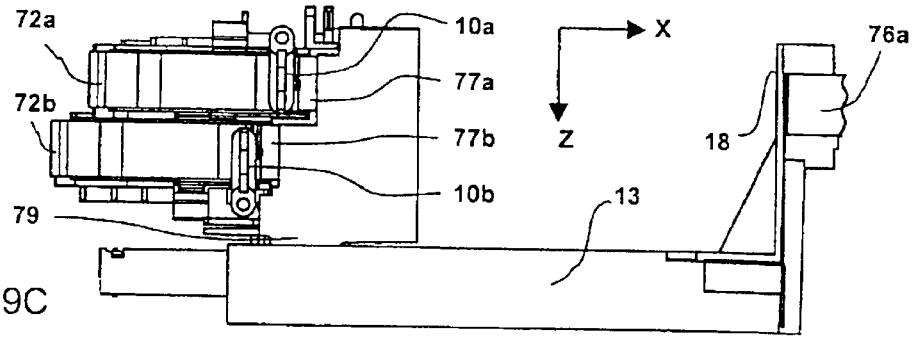
FIG. 9C is a plan view showing the fourth variant of the printing module.
Figure 9D:
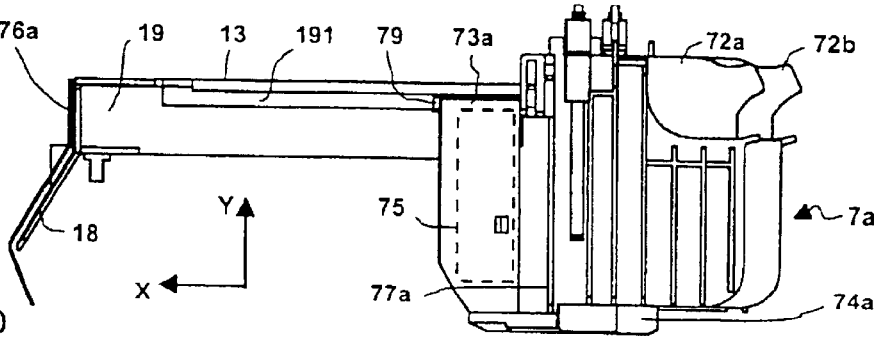
FIG. 9D is a left side view showing the fourth variant of the printing module in the printing position.

The plan view of the fourth variant of the printing module as illustrated in FIG. 9C illustrates, firstly, how the printing head drive electronics (which cannot be seen) are protected against unauthorized access from above by the protection cap 73*a* and, on the other hand, how the ribbon cable 76*a* is protected against unauthorized access from above by the protection wall 13. In order to replace empty ink cartridges, the lock is opened by operating the levers 10*a* and 10*b*, and new ink cartridges 72*a*, 72*b* are then inserted into the printing carriage 74*a*, with the ink printing heads making contact with the printing head drive electronics (which cannot be seen) via the interfaces 77*a* and 77*b*. The lock is then made once again with the levers 10*a* and 10*b*. The ribbon cable 76*a* is protected by the protection wall 13 against unauthorized access from above only in the area of the printing module 7*a*, with the area being accessible during replacement. In the rear area of the printing module 7*a*, the angled piece 18 is constructed such that the ribbon cable 76*a* is guided outside instead of within the movement area of the printing module 7*a*, with the movement area being bounded by the walls 63, 65, 66 and 69 of the box within the supporting frame (FIG. 4).

FIG. 9A shows a side view from the left of the fourth variant of the printing module, with the printing module 7*a* located in the printing position. The movement area of the printing module 7*a* is bounded in the Z direction by a guide wall 19, which together with the protection wall 13 forms the guide channel. The printing carriage 74*a* is fitted with printing head drive electronics 75 (illustrated by dashed lines since they cannot be seen), which can be connected by interfaces 71*a*, 71*b* to the ink cartridges 72*a*, 72*b*, and are covered by the protection cap 73*a*, with their sliding carriage 79 running in a guide slot 191 in the guide wall 19, and extending in the X direction.

Figure 10A:
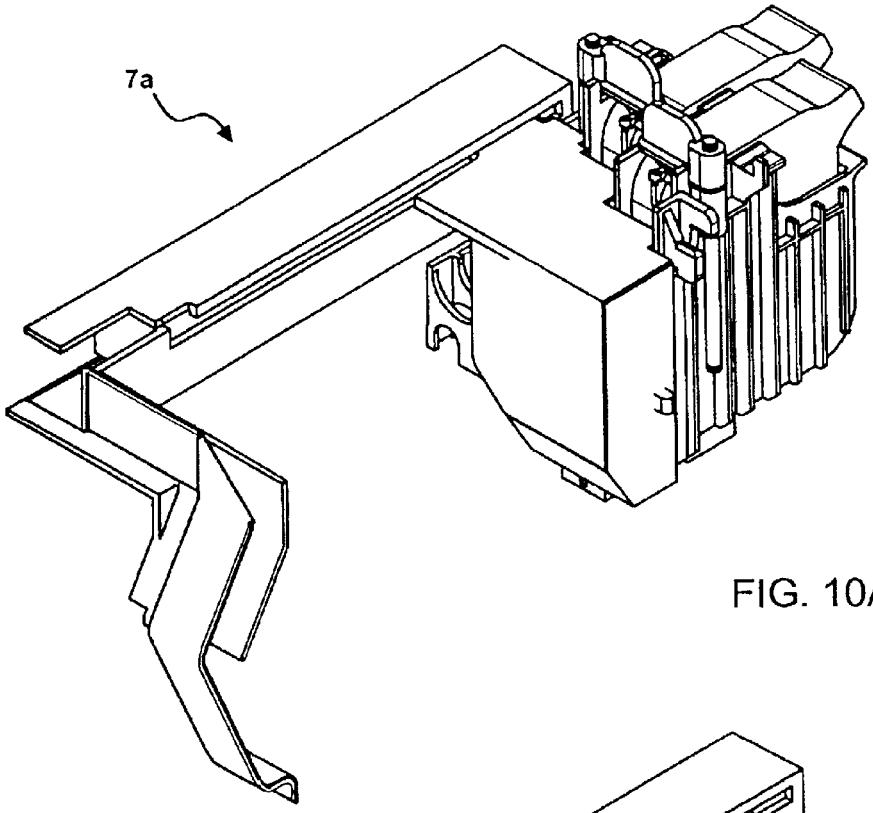
FIG. 10A is a rear perspective view showing the fourth variant of the printing module in the printing position.

FIG. 10A shows a perspective view from the rear of the fourth variant of the printing module, with the printing module 7*a* located in the printing position.

Figure 10B:
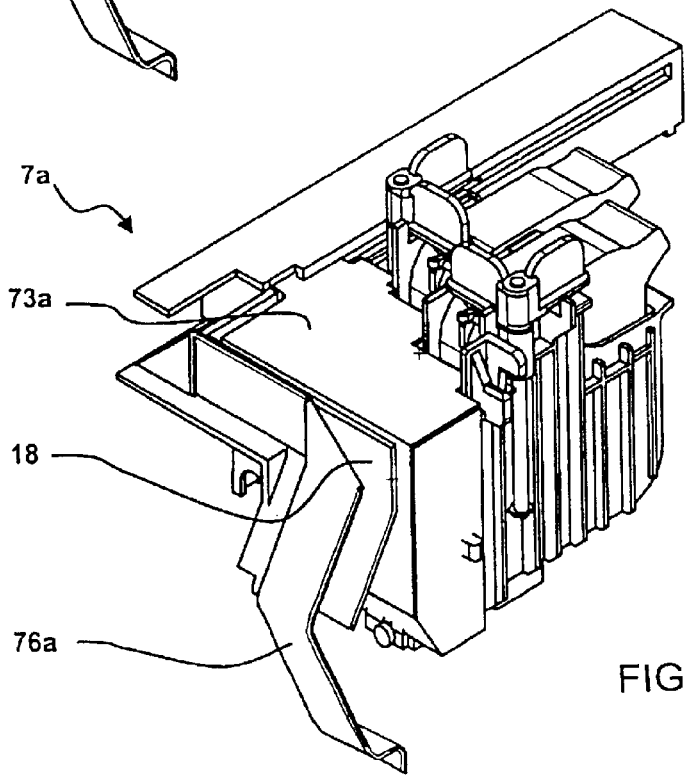
FIG. 10B is a rear perspective view showing the fourth variant of the printing module in the cartridge replacement position.

FIG. 10B shows a perspective view from the rear of the fourth variant of the printing module, with the printing module 7*a* being located at the position which is furthest away from the printing position, for example in the cartridge replacement position. The protection cap 73*a* in this case makes contact with the inner wall of the angled piece 18. Both figures show the folds in the ribbon cable 76*a*, which runs parallel to the Z direction and rests on the angled piece 18. A fold is required for each direction change in the ribbon cable 76*a*.

Figure 11A:
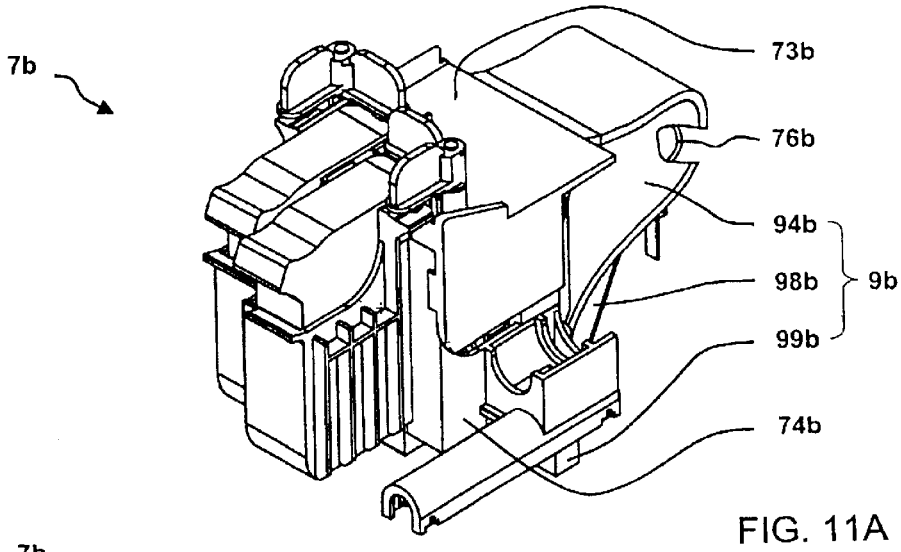
FIG. 11A is a front perspective view showing a fifth variant of the printing module.

FIG. 11A shows a perspective view from the front of a fifth embodiment of the printing module, with the connection of the ribbon cable 76*b* being located on the rear face of the printing carriage 74*b*, that is to say on the protection cap 73*b*, and with the ribbon cable 76*b* containing electrical conductors with are configured in a row in a line parallel to the Z direction, and with the ribbon cable 76*b* being configured with its flat face parallel to the XZ plane. The ribbon cable 76*b* is in this case routed within the movement area of the printing module 7*b*, with the movement area being bounded by the walls 63, 65, 66, and 69 of the box within the supporting frame (FIG. 4). In order to protect the electrical conductors, the ribbon cable 76*b* is protected against unauthorized access by a special flexible protection sheath 9*b*. The protection sheath 9*b* includes a pressed-flat piece of flexible tubing 94*b* and merges at one of its ends into the protection cap 73*b*, which is used for covering the printing head drive electronics. The piece of flexible tubing 94*b* is constructed to accommodate a ribbon conductor 76*b*, and preferably has a force-fitting and interlocking connection to the protection cap 73*b*, which is constructed for strain relief. A force-locking connection is one that connects two elements together by force external to the elements, as opposed to a form-locking connection, which is provided by the shapes of the elements themselves. The protection cap 73*b* is constructed to be attached to the printing module 7*b*, with the attachment being disposed such that the latter cannot accessed through the opening 24. The protection sheath 9*b* leads at its other end to a plug connector 99*b* that can be connected to the supporting frame 6 (FIG. 3), for example via a holder 98*b*, and is constructed for strain relief. The piece of flexible tubing 94*b* is, for example, produced from a particularly resistant plastic and is constructed to be flexible. The piece of flexible tubing 94*b* has a metallic all-round shield, which is not shown, for example a flexible internal copper wire mesh.

Figure 11B:
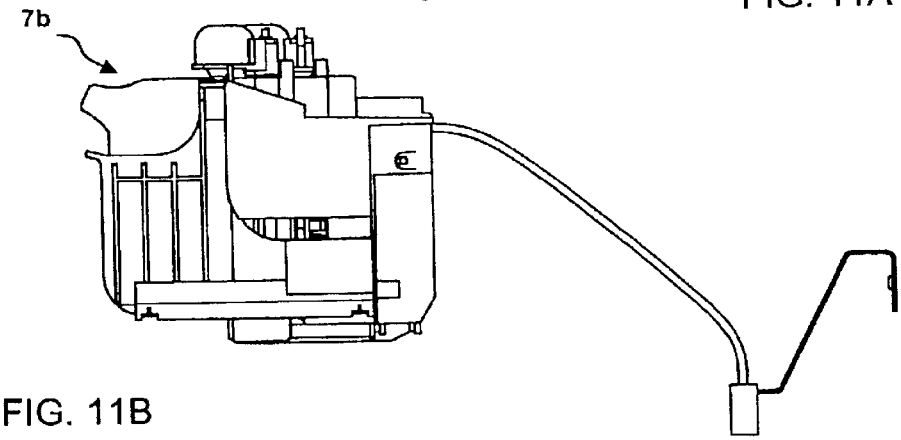
FIG. 11B is a left side view from of the fifth variant of the printing module in the printing position.

FIG. 11B shows the side view from the left of the fifth variant of the printing module, with the printing module 7*b* being located in the printing position.

Figure 11C:
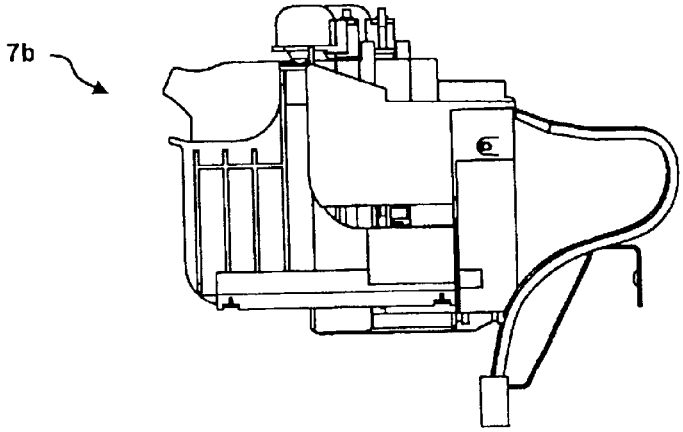
FIG. 11C is a left side view of the fifth variant of the printing module in the cartridge replacement position.

FIG. 11C shows the side view from the left of the fifth variant of the printing module, with the printing module 7*b* being located in the cartridge replacement position.

The invention is not restricted to the present embodiment. A large number of alternative chassis configurations are feasible within the context of the claims, with different configurations. For example, further other embodiments of the invention can obviously be developed and used that are based on the same fundamental idea of the invention and are covered by the attached claims.

We claim:

1. In a mail processing appliance having a non-secure area, a supporting frame for a printing mechanism in the non-secure area, a variable position printing module being disposed in the supporting frame, moveable transversely with respect to a transport direction of an item of mail over a movement area, and mechanically protected against unauthorized access, and a transverse movement device for transverse movement of the printing module; a configuration for protecting the printing module, comprising:

a housing upper part having an opening formed therein for replacing an ink cartridge;

a cover for covering said opening of said housing upper part;

a printing carriage;

a protection cap attached to said printing carriage and surrounding an area of the variable position printing module;

a box within the supporting frame having walls bounding the movement area of the printing module; and an impeding device impeding the transverse movement device from transversely moving the printing module upon opening or removing said cover.

2. The configuration according to claim 1, wherein:

said opening for replacing the ink cartridge is provided in said protection cap; and said protection cap surrounds said area of said variable position printing module to be protected.

3. The configuration according to claim 1, wherein said cover is an operating device for hand protection and is operable at any time.

4. The configuration according to claim 1, further comprising a switch disposed in said housing upper part, to be operated by said cover, and switching off the transverse movement device upon opening said cover.

5. The configuration according to claim 1, further comprising a sensor disposed in said housing upper part and to be activated by said cover to switch off the transverse movement device upon opening said cover.

6. The configuration according to claim 1, further comprising:

a printed circuit board having a secure area;

a supporting frame for the printing mechanism supported by said printed circuit board in the non-secure area;

at least two chassis shells disposed at a distance from one another and surrounding said printed circuit board to distance the non-secure area housing the printing module, and said opening in said security housing upper part from said secure area.

7. The configuration according to claim 1, wherein said cover is a flap.

8. The configuration according to claim 1, wherein said protection cap has at least two side walls and a cover plate.

9. The configuration according to claim 8, wherein said cover plate of said protection cap has a sealing guide strip.

10. The configuration according to claim 1, wherein said protection cap has at least two side walls, a cover plate, and a rear side wall.

11. The configuration according to claim 10, wherein said protection cap has a protection cap upper part with two side walls, a cover plate, and a first half of a rear side wall, said rear side wall having a missing second half; and has a protection cap lower part with a center plate, two angled side walls from said center plate, and a cover surface, said side walls having side edges and said center plate replacing said missing second half of said rear side wall, and said cover surface having side edges and being angled from said center plate, said side edges of said cover surface running parallel to said side edges of the side walls, and said cover surface of said protection cap lower part having an angled stop with an end remote from said center plate, said angle stop limiting any relative movement between said protection cap lower part and said protection cap upper part.

12. The configuration according to claim 1, further comprising:

printing head drive electronics;

a ribbon cable routed within the movement area of the printing module; and said printing head drive electronics and said ribbon cable being covered by said protection cap.

13. The configuration according to claim 12, further comprising a flexible protection sheath protecting said ribbon cable against unauthorized access.

14. The configuration according to claim 1, further comprising:

a guide channel having an angled piece disposed at an end thereof in an X direction;

printing head drive electronics;

a ribbon cable being routed outside the movement area of the printing module in said guide channel;

said printing head drive electronics and said ribbon cable being covered by said protection cap.

15. The configuration according to claim 14, wherein:

said ribbon cable has a minimum permissible bending radius;

said ribbon cable rests on said angled piece and has a fold; and said guide channel is formed from a guide wall, a protection wall, and a channel wall parallel to said protection wall, said protection wall and said channel wall being spaced at a distance from one another greater than said minimum permissible bending radius of the ribbon cable; and the movement area of the printing module being bounded in a Z direction by said guide wall.

16. The configuration according to claim 15, wherein:

said guide wall has a guide slot formed therein and running in the X direction;

said printing carriage has a side; and a sliding carriage is attached to said side of said printing carriage, runs in said guide slot in said guide wall, and has a connection for said ribbon cable.

17. A mail processing appliance, comprising:

a non-secure area;

a supporting frame for a printing mechanism in said non-secure area;

a variable position printing module being disposed in said supporting frame, moveable transversely with respect to a transport direction of an item of mail over a movement area, and mechanically protected against unauthorized access;

a transverse movement device for transverse movement of said printing module;

a housing upper part having an opening formed therein for replacing an ink cartridge;

a cover for covering said opening of said housing upper part;

a printing carriage;

a protection cap attached to said printing carriage and surrounding an area of said variable position printing module;

a box within said supporting frame having walls bounding said movement area of said printing module; and an impeding device impeding said transverse movement device from transversely moving said printing module upon opening or removing said cover.

* * * * *

UNITED STATES PATENT AND TRADEMARK OFFICE

CERTIFICATE OF CORRECTION

PATENT NO. : 6,789,892 B2
DATED : September 14, 2004
INVENTOR(S) : Ulrich Hetzer et al.

It is certified that error appears in the above-identified patent and that said Letters Patent is hereby corrected as shown below:

Title page,
Item [73], Assignee, should read as follows:
-- Francotyp-Postalia AG & Co. KG, Birkenwerder (DE) --

Signed and Sealed this

Nineteenth Day of July, 2005

JON W. DUDAS
*Director of the United States Patent and Trademark Office*